US007233196B2

(12) United States Patent
Farooqui

(10) Patent No.: US 7,233,196 B2
(45) Date of Patent: Jun. 19, 2007

(54) BANDGAP REFERENCE VOLTAGE GENERATOR

(75) Inventor: Arshad Suhail Farooqui, Cyberjaya (MY)

(73) Assignee: Sires Labs Sdn. Bhd. (MY)

( * ) Notice: Subject to any disclaimer, the term of this patent is extended or adjusted under 35 U.S.C. 154(b) by 82 days.

(21) Appl. No.: 10/601,204

(22) Filed: Jun. 20, 2003

(65) Prior Publication Data

US 2004/0257150 A1 Dec. 23, 2004

(51) Int. Cl.
*G05F 1/10* (2006.01)
*G05F 3/02* (2006.01)

(52) U.S. Cl. ..... 327/541; 327/539

(58) Field of Classification Search ..... 327/538–541, 327/543

See application file for complete search history.

(56) References Cited

U.S. PATENT DOCUMENTS 5,229,706 A * 7/1993 Fujiwara ..... 320/150
5,262,688 A * 11/1993 Tateishi ..... 327/362
5,512,817 A 4/1996 Nagaraj ..... 323/316
5,936,392 A 8/1999 Taylor ..... 323/315
6,127,881 A * 10/2000 Tsay et al. ..... 327/538
6,150,872 A 11/2000 McNeill et al. ..... 327/539
6,154,057 A * 11/2000 Shao et al. ..... 326/63
6,157,245 A * 12/2000 Rincon-Mora ..... 327/539
6,297,671 B1 * 10/2001 Shih et al. ..... 327/74
6,441,594 B1 * 8/2002 Connell et al. ..... 323/274
6,465,997 B2 10/2002 Kussener ..... 323/313
6,529,563 B1 * 3/2003 Mosinskis et al. ..... 375/317
6,774,712 B2 * 8/2004 Rhee et al. ..... 327/540
2003/0085754 A1 * 5/2003 Lim ..... 327/540

* cited by examiner

*Primary Examiner*—Quan Tra
(74) *Attorney, Agent, or Firm*—DeMont & Breyer, LLC

(57) ABSTRACT

An electrical circuit is disclosed that is capable of improving the power supply rejection ratio of a standard bandgap reference while maintaining the temperature coefficient of the standard design. One embodiment of the circuit comprises a bandgap reference voltage generator, an operational amplifier, a transistor, a voltage divider, a startup network, and a self-biasing network that provide a voltage reference with improved characteristics.

20 Claims, 4 Drawing Sheets

301
V1
321
303
M5
M6
M12
M13
R1
R2
R3
C1
C2
Q1
Q2
Q3
Q4
M9
M10
M11
323
322
324
305
M33
M34
M31
M32
M30
C3
325
M35
326
309
M40
M41
M42
M43
C4
311
M50
M51
M52
C5
328
VOUT
315
M60
M61

BANDGAP REFERENCE VOLTAGE GENERATOR

FIELD OF THE INVENTION

The present invention relates to electronics in general, and, more particularly, to a circuit for providing a bandgap voltage reference.

BACKGROUND OF THE INVENTION

Applications for portable, battery-operated equipment or systems employing complex, high-performance electronic circuitry have increased with the widespread use of cellular telephones, laptop computers, and other systems. Maintaining the accuracy of many of these circuits is directly dependent on the stability of a reference voltage. A bandgap reference generator produces such a reference voltage. The reference voltage produced is approximately equal to the band gap voltage of silicon, which is approximately 1.2 volts. It is desirable that such a bandgap reference voltage be substantially immune to temperature variations, power supply variations, and noise.

FIG. 1 depicts a schematic diagram of a bandgap reference architecture in the prior art. Power supply 101 feeds an unregulated (i.e., fluctuating) signal to biasing network 103 and bandgap reference 105. Biasing network 103 provides a biasing signal via lead 115 to bandgap reference 105. Power supply 101, biasing network 103, and bandgap reference 105 are tied together via common lead 113, which is grounded. Bandgap reference 105 provides a reference signal, $V_{out}$, via lead 117.

FIG. 2 depicts a schematic diagram of the same bandgap reference in the prior art as is depicted in FIG. 1, but at the circuit (i.e., lower) level of abstraction. M90 through M93 comprise a biasing network, the output of which, labeled 115, is fed to the gate of transistor M9. M9 acts as a current source for an error, or operational, amplifier comprising M9 through M13. The error amplifier senses the voltage levels at the gates of M10 and M11 and controls the currents through M5 and M6. The voltages at the gates of M10 and M11 are approximately equal due to the negative feedback of R1, R3, M5, and M6. Q1 through Q4 provide about twice the bandgap voltage of silicon, or 2.4 Volts. The bandgap transistors Q1 through Q4 also have canceling positive and negative temperature coefficients, so that the reference voltage output at 117, also the output of the error amplifier, is constant with temperature. Having two transistors cascaded as in Q1/Q2 or Q3/Q4 pairs reduces the offset voltage of the error amplifier, improving the accuracy of the output voltage. If R1=R3, the output voltage of the overall bandgap reference of the prior art can be expressed as:

$$V_{out}=V_{be(Q1)}+V_{be(Q2)}+2*V_t*In(n)*(R2+R3)/R3 \quad \text{(Eq. 1)}$$

Where $V_t$ is the threshold voltage of bipolar transistors (Q1 through Q4) and n is the emitter area ratio of Q1 and Q3. The emitter ratio of Q1/Q3 is equal to the emitter ratio of Q2/Q4 because Q1=Q2 and Q3=Q4.

Although this circuit is well known and widely used, it is disadvantageous in that it suffers from, among other things, a poor power supply rejection ratio (PSRR).

SUMMARY OF THE INVENTION

The present invention provides a mechanism for improving the characteristics of a reference circuit, while avoiding many of the costs and restrictions associated with prior techniques. Specifically, embodiments of the present invention adds a self-biasing network to enable an improved power supply rejection ratio while maintaining temperature coefficient characteristics. The sub-circuits comprising the illustrative embodiment are a bandgap reference voltage generator, an operational amplifier, a transistor, a voltage divider, a startup network, and a self-biasing network.

An illustrative embodiment of the present invention comprises: a first transistor having a gate, a source, and a drain; a second transistor having a gate, a source, and a drain, wherein the gate of the second transistor is electrically connected to the gate of the first transistor, and wherein the source of the first transistor is electrically connected to the source of the second transistor; a first resistor having a first terminal and a second terminal, wherein the first terminal of the first resistor is electrically connected to the drain of the first transistor; a first capacitor having a first terminal and a second terminal, wherein the first terminal of the first capacitor is electrically connected to the drain of the first transistor; a second resistor having a first terminal and a second terminal, wherein the first terminal of the second resistor is electrically connected to the drain of the second transistor; and a second capacitor having a first terminal and a second terminal, wherein the first terminal of the second capacitor is electrically connected to the drain of the second transistor.

DETAILED DESCRIPTION

Figure 1:
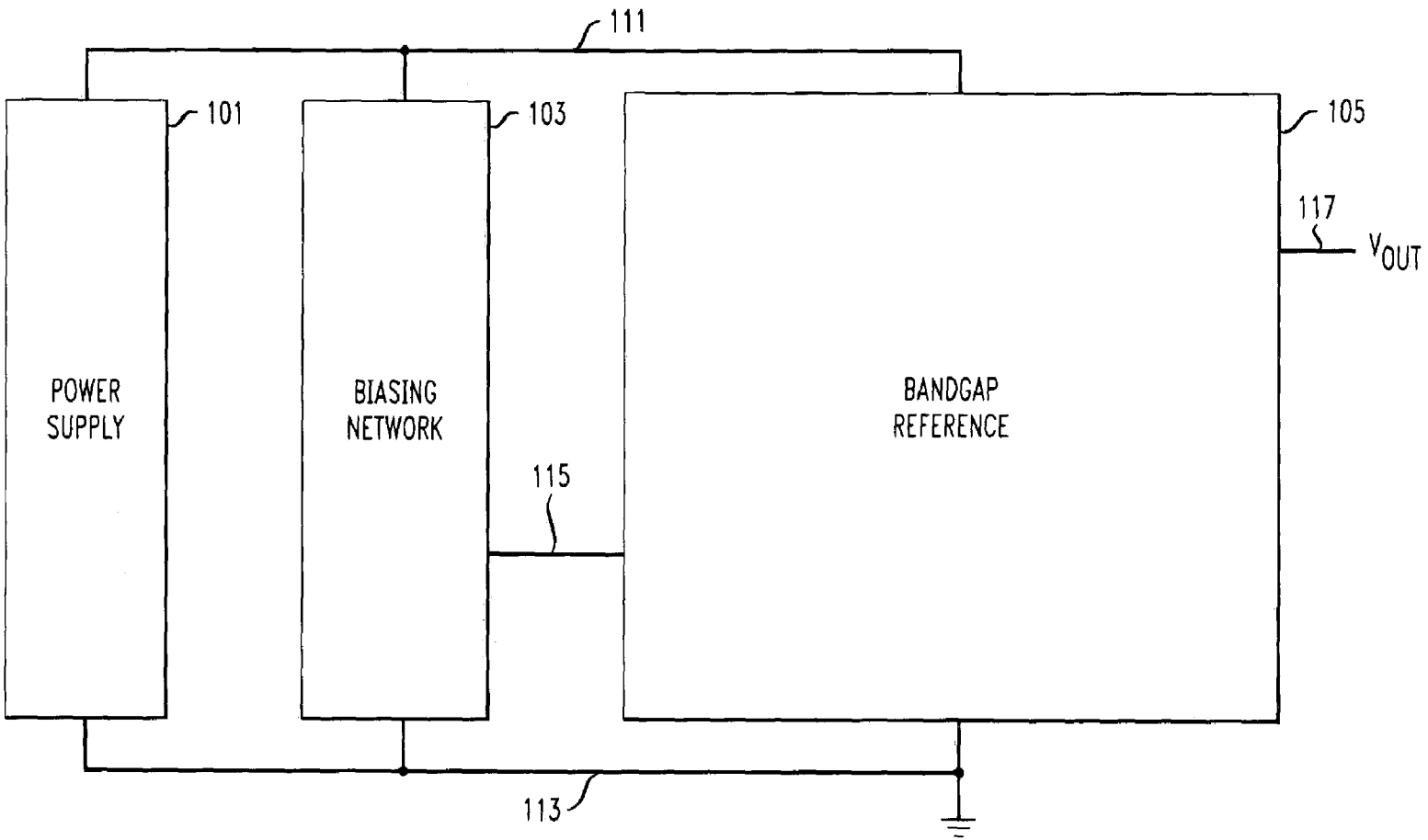
FIG. 1 PRIOR ART
FIG. 1 depicts a schematic diagram of a bandgap reference architecture in the prior art.
Figure 2:
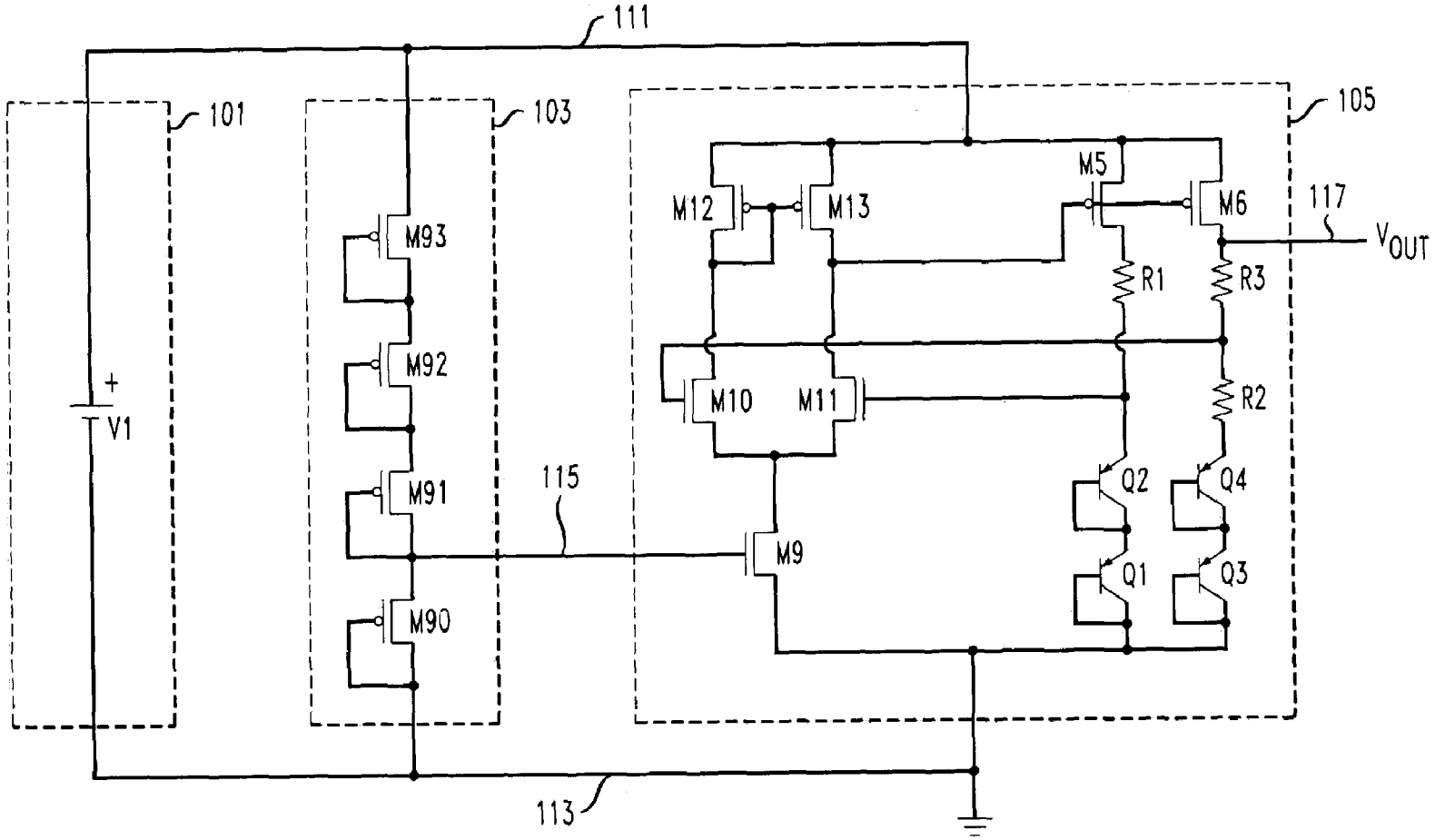
FIG. 2 PRIOR ART
FIG. 2 depicts a schematic diagram of a bandgap reference circuit in the prior art.
Figure 3:
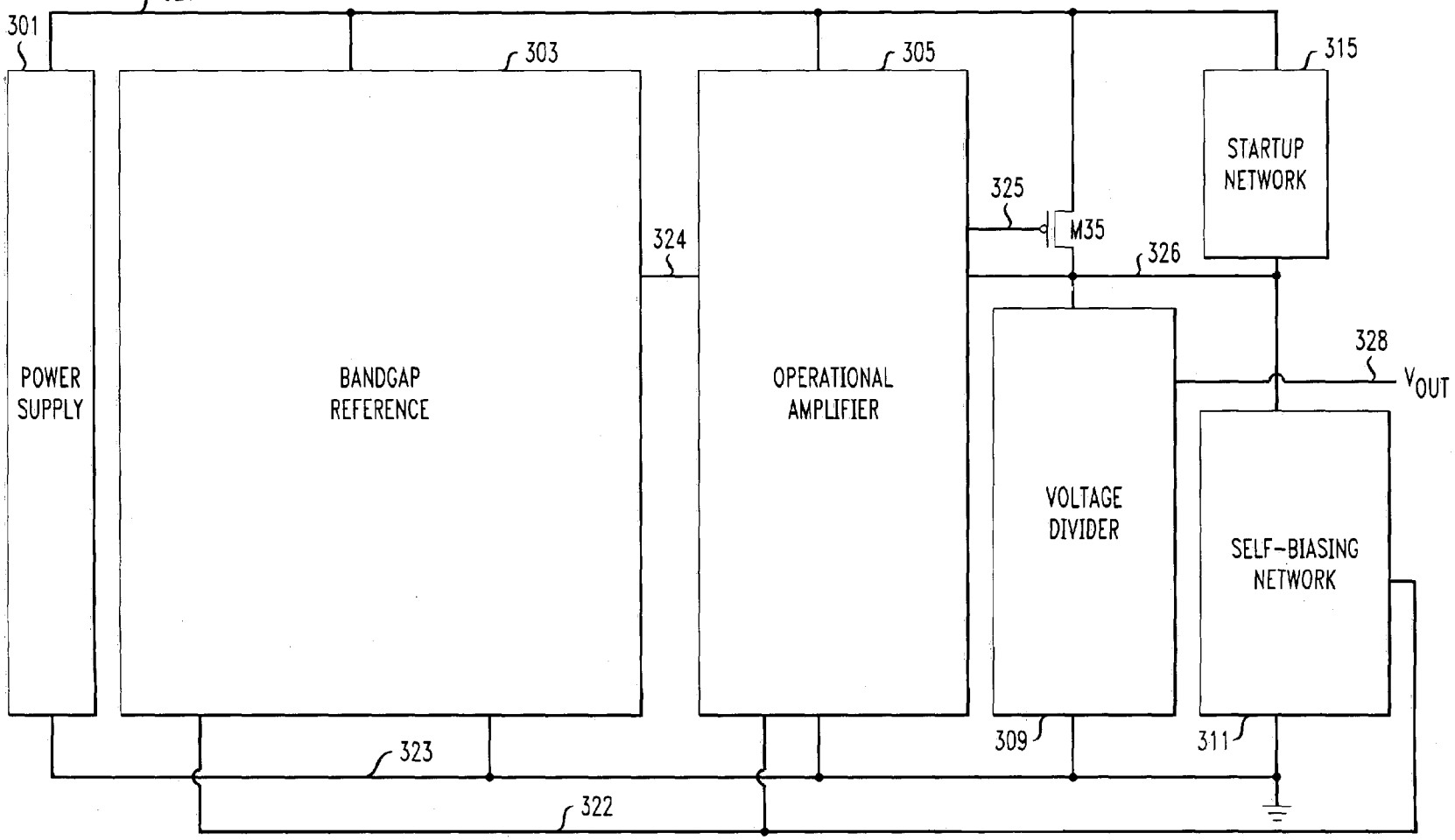
FIG. 3 depicts a schematic diagram of a bandgap reference architecture in accordance with the illustrative embodiment of the present invention.

FIG. 3 depicts a schematic diagram of a bandgap reference architecture in accordance with the illustrative embodiment of the present invention. Power supply 301 feeds an unregulated signal in well-known fashion to bandgap reference 303, operational amplifier 305, transistor M35, and startup network 315 via lead 321.

Startup network 315 ensures an initial biasing voltage to pull the error amplifiers constituting bandgap reference 303 in working state. Startup network 315 does so by outputting a signal on lead 326 used by self-biasing network 311. Self-biasing network 311 takes the signal on lead 326 and outputs a biasing signal on lead 322 that is used by bandgap reference 303 and operational amplifier 305.

Bandgap reference 303 is a voltage generator. Bandgap reference 303 provides a reference signal via lead 324 to operational amplifier 305 by using input signals on leads 321 and 322. Operational amplifier 305 inputs the raw reference signal on lead 324, together with the signals on leads 321, 322, and 326, and outputs an amplified reference signal on lead 325.

Transistor M35 comprises a gate, a source, and a drain, and is a p-type metal oxide semiconductor (PMOS) device.

The signal on lead 321 is fed into the source. The signal on lead 325 is fed into the gate. The drain of transistor M35 ties into lead 326.

Voltage divider 309 takes the signal on lead 326 and outputs the proper voltage reference signal on lead 328.

Power supply 301, bandgap reference 303, operational amplifier 305, voltage divider 309, and self-biasing network 311 are tied together via common lead 323, which is also tied to ground.

Figure 4:
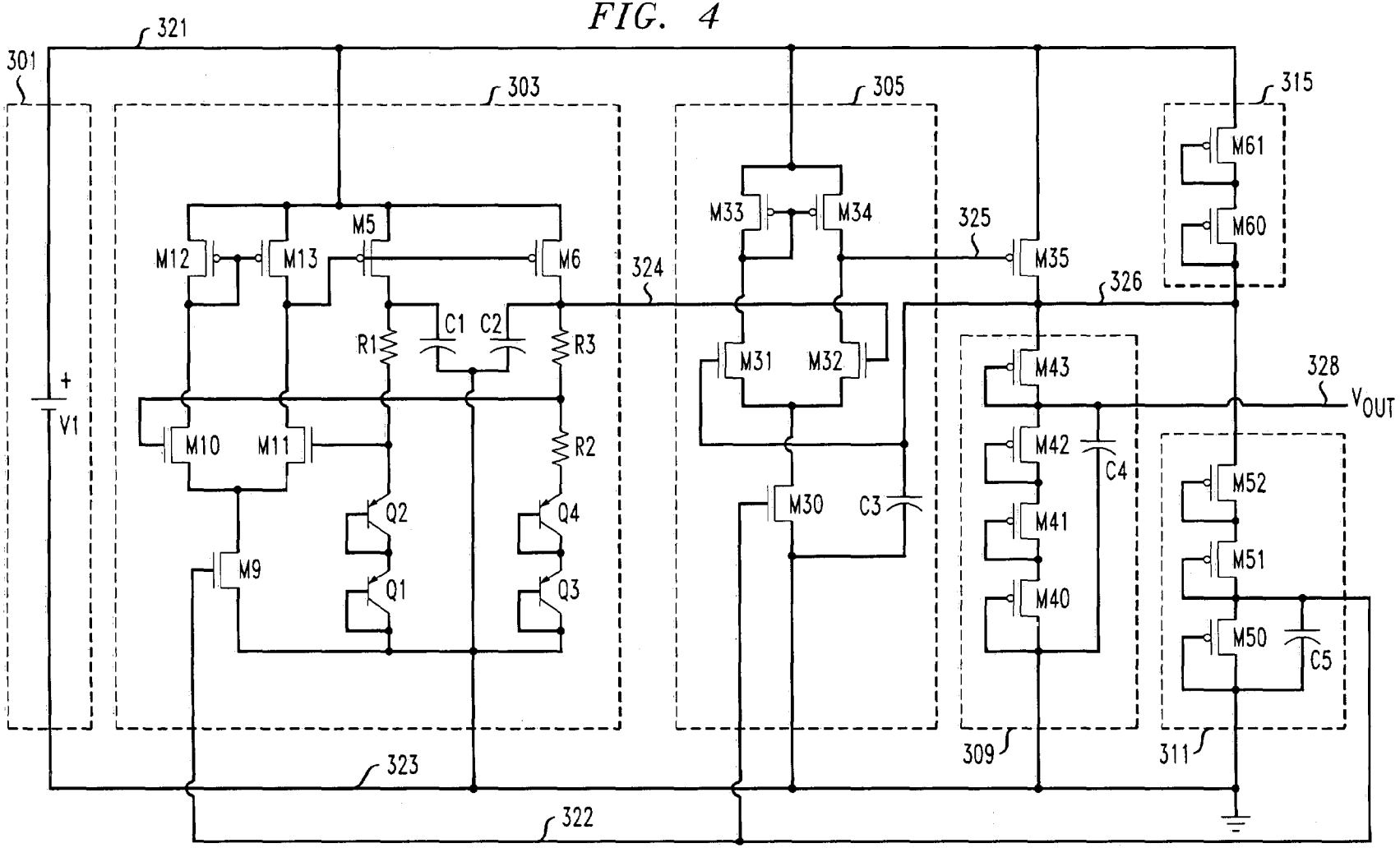
FIG. 4 depicts a schematic diagram of a bandgap reference circuit in accordance with the illustrative embodiment of the present invention.

FIG. 4 depicts a schematic diagram of the same bandgap reference, but at the circuit level, in accordance with the illustrative embodiment of the present invention. Power supply 301 comprises voltage source V1 with positive voltage applied to lead 321. Startup network 315 comprises transistors M60 and M61, interconnected as shown. The signal on lead 321 is fed into the source of transistor M61. The drain of transistor M60 ties into lead 326.

Self-biasing network 311 comprises transistors M50 through M52 and capacitor C5, interconnected as shown. In self-biasing network 311, the voltage present on lead 328 is divided by three and provided via lead 322 to the tail transistors M9 and M30 of the error amplifiers within bandgap reference 303 and operational amplifier 305, respectively. By providing the reduced voltage, the dependence of the error amplifiers' biasing voltages on power supply 301 is reduced, consequently improving the power supply rejection ratio. At the same time, the temperature coefficient of the design is maintained. The source of transistor M52 is connected to lead 326. The gate of transistor M52 is connected to the drain of transistor M52. The source of transistor M51 is connected to the drain of transistor M52. The gate of transistor M51 is connected to the drain of transistor M51. The source of transistor M50 is connected to the drain of transistor M51. The gate of transistor M50 is connected to the drain of transistor M50. The drain of transistor M50 is connected to lead 323. Transistors M50 through M52 are PMOS devices. Capacitor C5 lies between leads 322 and 323.

Bandgap reference 303 comprises: transistors Q1 through Q4, transistors M9 through M13, transistors M5 and M6, resistors R1 through R3, and capacitors C1 and C2, interconnected as shown. Transistors M9 through M13 constitute the error amplifier within bandgap reference 303. The drain of transistor M9 is tied to lead 323. The sources of transistors M5, M6, M12, and M13 are tied to lead 321. The gates of transistors M5 and M6 are tied to each other. The drain of transistor M5 is tied to resistor R1 and capacitor C1. The drain of transistor M6 is tied to resistor R3 and capacitor C2 at lead 324. Capacitor C2 lies between leads 323 and 324.

In accordance with the illustrative embodiment, the value of resistor R1 equals the value of resistor R2, and the value of capacitor C1 equals the value of capacitor C2.

Operational amplifier 305 comprises transistors M30 through M34 operating as an error amplifier and capacitor C3, interconnected as shown. The bias signal on lead 322 is fed into transistor M30. The drain of transistor M30 is tied to lead 323. The signal on lead 321 is fed into the sources of transistors M33 and M34. The signal on lead 324 as provided by bandgap reference 303 is fed into the gate of transistor M32. The drain of transistor M34 is tied to lead 325. Capacitor C3 lies between lead 323 and 326.

Voltage divider 309 comprises transistors M40 through M43 and capacitor C4, interconnected as shown. Voltage divider 309 provides reference signal $V_{out}$ on lead 328 at a voltage level that is three-fourths of the voltage level present on lead 326.

Capacitors C1 through C5 further assist in damping the effect of power supply variation the signal on lead 324.

The output voltage of the illustrative embodiment, $V_{out}$, is equal to:

$$V_{out} = \frac{3\left[V_{be}(Q_1) + V_{be}(Q2) + 2V_t\ln(n)\left(\frac{R_2 + R_3}{R_3}\right)\right]}{4} \quad \text{(Eq. 2)}$$

wherein $V_{be}(Q_1)$ is the base-emitter voltage in transistor $Q_l$, $V_{be}(Q_2)$ is the base-emitter voltage in transistor $Q_2$, $V_t$ is the threshold voltage of Where $V_t$ is the threshold voltage of bipolar transistors (Q1 through Q4) and n is the emitter area ratio of Q1 and Q3. The emitter ratio of Q1/Q3 is equal to the emitter ratio of Q2/Q4 because Q1=Q2 and Q3=Q4.

It is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

What is claimed is:

1. An apparatus comprising:

a bandgap reference voltage generator having an output terminal and a bias terminal;

an operational amplifier having a positive input terminal, a negative input terminal, and an output terminal, wherein the negative input terminal of said operational amplifier is electrically connected directly to the output terminal of said bandgap reference voltage generator without intervening elements;

a transistor having a gate, a source, and a drain, wherein the gate of said transistor is electrically connected directly to the output of said operational amplifier without intervening elements, and wherein the drain of said transistor is electrically connected directly to the positive input terminal of said operational amplifier without intervening elements;

a voltage divider having a input terminal, an output terminal, and a common terminal, wherein said input terminal of said voltage divider is electrically connected directly to the positive input terminal of said operational amplifier without intervening elements;

a startup network having a first positive supply terminal and an output terminal, wherein said output terminal of said startup network is electrically connected directly to said input terminal of said voltage divider without intervening elements; and a self-biasing network having a second positive supply terminal, a common terminal, and an output terminal, wherein said second positive supply terminal of said self-biasing network is electrically connected directly to said output terminal of said startup network without intervening elements, and wherein said common terminal of said self-biasing network is electrically connected directly to said common terminal of said voltage divider without intervening elements, and further wherein said output terminal of said self-biasing network is electrically connected directly to the bias terminal of said bandgap voltage reference generator without intervening elements.

2. The apparatus of claim 1 wherein said transistor is a PMOS transistor.

3. The apparatus of claim 1 wherein said operational amplifier also comprises a bias terminal, and wherein said output terminal of said self-biasing network is electrically connected directly to said bias terminal of said operational amplifier without intervening elements.

4. The apparatus of claim 1 wherein said bandgap reference voltage generator further comprises a positive supply terminal and a common terminal, and wherein said operational amplifier also comprises a positive supply terminal and a common terminal, and wherein said positive supply terminal of said bandgap reference voltage generator is electrically connected directly to said positive supply terminal of said operational amplifier without intervening elements, and said common terminal of said bandgap reference voltage generator is electrically connected directly to said common terminal of said operational amplifier without intervening elements.

5. The apparatus of claim 4 wherein said common terminal of said voltage divider is electrically connected directly to said common terminal of said operational amplifier without intervening elements.

6. The apparatus of claim 4 wherein said positive supply terminal of said startup network is electrically connected directly to said positive supply terminal of said operational amplifier without intervening elements.

7. The apparatus of claim 4 wherein said source terminal of said transistor is electrically connected directly to said positive supply terminal of said operational amplifier without intervening elements.

8. The apparatus of claim 5 wherein said bandgap reference voltage generator further comprises a first capacitor having a first terminal and a second terminal, wherein:

said first terminal of said first capacitor is electrically connected directly to said output terminal of said bandgap reference voltage generator without intervening elements; and said second terminal of said first capacitor is electrically connected directly to said common terminal of said bandgap reference voltage generator without intervening elements.

9. The apparatus of claim 8 wherein said operational amplifier further comprises a second capacitor having a first terminal and a second terminal, wherein:

said first terminal of said second capacitor is electrically connected directly to said negative input terminal of said operational amplifier without intervening elements; and said second terminal of said second capacitor is electrically connected directly to said common terminal of said operational amplifier without intervening elements.

10. The apparatus of claim 9 wherein said voltage divider further comprises a third capacitor having a first terminal and a second terminal, wherein:

said first terminal of said third capacitor is electrically connected directly to said output terminal of said voltage divider without intervening elements; and said second terminal of said third capacitor is electrically connected directly to said common terminal of said voltage divider without intervening elements.

11. The apparatus of claim 10 wherein said self-biasing network further comprises a fourth capacitor having a first terminal and a second terminal, wherein:

said first terminal of said fourth capacitor is electrically connected directly to said output terminal of said self-biasing network without intervening elements; and said second terminal of said fourth capacitor is electrically connected directly to said common terminal of said self-biasing network without intervening elements.

12. An apparatus comprising:

a bandgap reference voltage generator having an output terminal;

an operational amplifier having a positive input terminal, a negative input terminal, a bias terminal, and an output terminal, wherein the negative input terminal of said operational amplifier is electrically connected directly to the output terminal of said bandgap reference voltage generator without intervening elements;

a transistor having a gate, a source, and a drain, wherein the gate of said transistor is electrically connected directly to the output of said operational amplifier without intervening elements, and wherein the drain of said transistor is electrically connected directly to the positive input terminal of said operational amplifier without intervening elements;

a voltage divider having a input terminal, an output terminal, and a common terminal, wherein said input terminal of said voltage divider is electrically connected directly to the positive input terminal of said operational amplifier without intervening elements;

a startup network having a first positive supply terminal and an output terminal, wherein said output terminal of said startup network is electrically connected directly to said input terminal of said voltage divider without intervening elements; and a self-biasing network having a second positive supply terminal, a common terminal, and an output terminal, wherein said second positive supply terminal of said self-biasing network is electrically connected directly to said output terminal of said startup network without intervening elements, and wherein said common terminal of said self-biasing network is electrically connected directly to said common terminal of said voltage divider without intervening elements. and further wherein said outDut terminal of said self-biasing network is electrically connected directly to said bias terminal of said operational amplifier without intervening elements.

13. The apparatus of claim 12 wherein said bandgap reference voltage generator further comprises a positive supply terminal and a common terminal, and wherein said operational amplifier also comprises a positive supply terminal and a common terminal, and wherein said positive supply terminal of said bandgap reference voltage generator is electrically connected directly to said positive supply terminal of said operational amplifier without intervening elements, and said common terminal of said bandgap reference voltage generator is electrically connected directly to said common terminal of said operational amplifier without intervening elements.

14. The apparatus of claim 13 wherein said positive supply terminal of said startup network is electrically connected directly to said positive supply terminal of said operational amplifier without intervening elements.

15. The apparatus of claim 13 wherein said source terminal of said transistor is electrically connected directly to said positive supply terminal of said operational amplifier without intervening elements.

16. The apparatus of claim 13 wherein said common terminal of said voltage divider is electrically connected directly to said common terminal of said operational amplifier without intervening elements.

17. The apparatus of claim 16 wherein said bandgap reference voltage generator further comprises a first capacitor having a first terminal and a second terminal, wherein:

said first terminal of said first capacitor is electrically connected directly to said output terminal of said bandgap reference voltage generator without intervening elements; and said second terminal of said first capacitor is electrically connected directly to said common terminal of said bandgap reference voltage generator without intervening elements.

18. The apparatus of claim 17 wherein said operational amplifier further comprises a second capacitor having a first terminal and a second terminal, wherein:

said first terminal of said second capacitor is electrically connected directly to said negative input terminal of said operational amplifier without intervening elements; and said second terminal of said second capacitor is electrically connected directly to said common terminal of said operational amplifier without intervening elements.

19. The apparatus of claim 18 wherein said voltage divider further comprises a third capacitor having a first terminal and a second terminal, wherein:

said first terminal of said third capacitor is electrically connected directly to said output terminal of said voltage divider without intervening elements; and said second terminal of said third capacitor is electrically connected directly to said common terminal of said voltage divider without intervening elements.

20. The apparatus of claim 19 wherein said self-biasing network further comprises a fourth capacitor having a first terminal and a second terminal, wherein:

said first terminal of said fourth capacitor is electrically connected directly to said output terminal of said self-biasing network without intervening elements; and said second terminal of said fourth capacitor is electrically connected directly to said common terminal of said self-biasing network without intervening elements.

* * * * *